US005142760A

United States Patent [19]

Bell

[11] Patent Number: 5,142,760

[45] Date of Patent: Sep. 1, 1992

[54] ARTICULATING IDLER ROLL

[75] Inventor: Conrad J. Bell, Webster, N.Y.

[73] Assignee: Xerox Corporation, Stamford, Conn.

[21] Appl. No.: 360,176

[22] Filed: Jun. 1, 1989

[51] Int. Cl.[5] ..... B21B 31/08

[52] U.S. Cl. ..... 29/130; 29/132

[58] Field of Search ..... 29/130, 132

[56] References Cited

U.S. PATENT DOCUMENTS

| | | | |
|---|---|---|---|
| 1,983,796 | 12/1934 | Geyer | 29/130 |
| 2,374,194 | 4/1945 | Grupe | 29/132 |
| 3,522,643 | 8/1970 | Winkler | 29/130 |
| 3,593,027 | 7/1971 | Grieger | 29/130 X |
| 3,750,246 | 8/1973 | Pessen | 29/130 |
| 3,883,293 | 5/1975 | McCarroll | 432/60 |
| 3,945,723 | 3/1976 | Cook et al. | 29/130 X |
| 4,149,797 | 4/1979 | Imperial | 355/3 FU |
| 4,287,649 | 9/1981 | Kohler | 29/130 |
| 4,309,803 | 1/1982 | Blaszak | 29/130 |
| 4,440,295 | 4/1984 | Blackwood-Murray | 29/132 X |
| 4,518,244 | 5/1985 | Kageyama et al. | 29/132 |
| 4,864,343 | 9/1989 | Nelson | 29/132 X |
| 4,883,715 | 11/1989 | Kuge et al. | 29/132 X |

FOREIGN PATENT DOCUMENTS

| | | | |
|---|---|---|---|
| 177626 | 4/1922 | United Kingdom | 29/130 |
| 0099250 | 1/1984 | United Kingdom . | |
| 2123524 | 2/1984 | United Kingdom . | |

*Primary Examiner*—Mark Rosenbaum
*Assistant Examiner*—Frances Chin
*Attorney, Agent, or Firm*—William A. Henry, II

[57] ABSTRACT

A one piece, low cost, self-loading, articulating and hard surfaced idler roll is provided for use in a xerographic copying machine or the like. The idler roll includes an outer core with a surface of sufficient hardness to be non-compliant when sheet material and a drive roll comes into contact with it. A compliant material is positioned between a shaft which can be hollow and the outer core in order to complete the one piece structure and allow the idler roll to articulate about the shaft to diminish skewed entry of sheets into the nip formed between the idler roll and the drive roll.

3 Claims, 2 Drawing Sheets

ARTICULATING IDLER ROLL

This invention relates to printing machines, and more particularly, to an articulating idler roll to be used in such a machine.

In the art of xerography or other similar image reproducing arts, a latent electrostatic image is formed on a charge-retentive surface such as a photocondutor which generally comprises a photoconductive insulating material adhered to a conductive backing. This photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, the latent electrostatic image may be generated from information electronically stored or generated, and the digital information may be converted to alphanumeric images by image generation electronics and optics. However, such image generation electronic and optic devices form no part of the present invention.

Idler rolls are used in conjunction with drive rolls throughout printers or copiers of the type just discussed in order to form nips that convey or transport sheets or media. For example, United Kingdom Patent Application No. 2,123,524 A and European Patent Application Publication No. 0 099 250 both disclose a drive roller for conveying a compiled set of sheets from a stationary condition to in a compiling tray toward a finishing device, having a peripheral surface coefficient of friction of less that 0.5 and a hardness of less than 40 IRHD. In a preferred form, the roller is composed of an outer skin of hard, deformable plastics material surrounding a soft inner core. Other references showing various rollers having an outer skin of deformable plastic material surrounding a soft inner core include U.S. Pat. Nos. 3,883,293; 4,149,797; 4,287,649 and 4,309,803.

Heretofore, in applications where sheets are guided into a nip, hard surfaced idler and drive rolls tended to transmit and sometimes magnify skew while conveying the sheets to another location. In addition, the rolls are high in cost since they consisted of a roll axle, bearings, mounting and pressure devices.

Accordingly, a one piece, low cost, self-loading, articulating idler roll is disclosed that includes an outer core member having an outer surface of sufficient hardness to be non-compliant when sheet material and a drive roll comes into contact with it; an inner core member that is hollow or solid; and a compliant material positioned between said inner and outer core members in order to allow said idler roll to articulate about the inner core to diminish skewed entry of sheet material into the nip between the idler roll and the drive roll.

Figure 1:
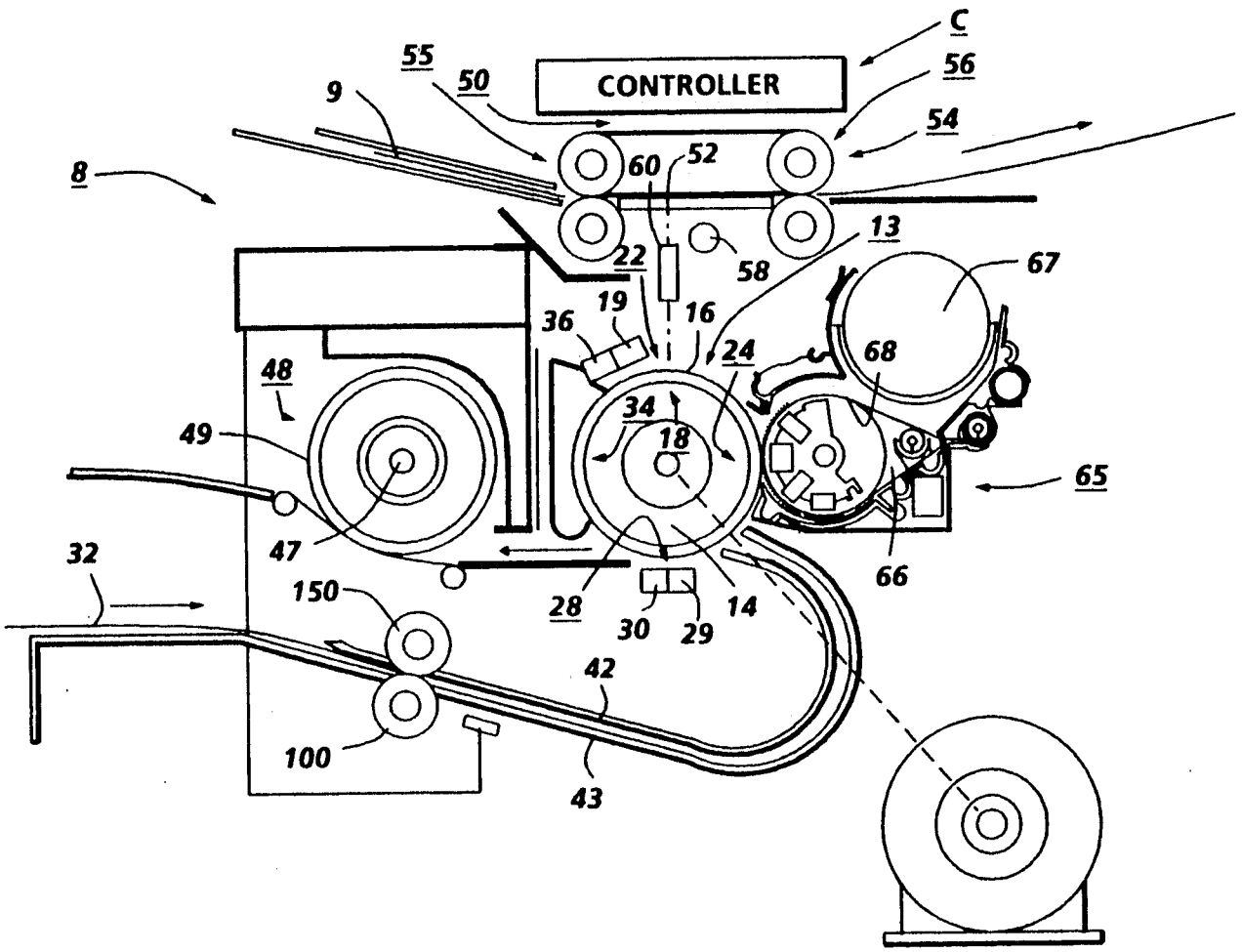
FIG. 1 is a side view schematic of a machine incorporating the features of the present invention.
Figure 2:
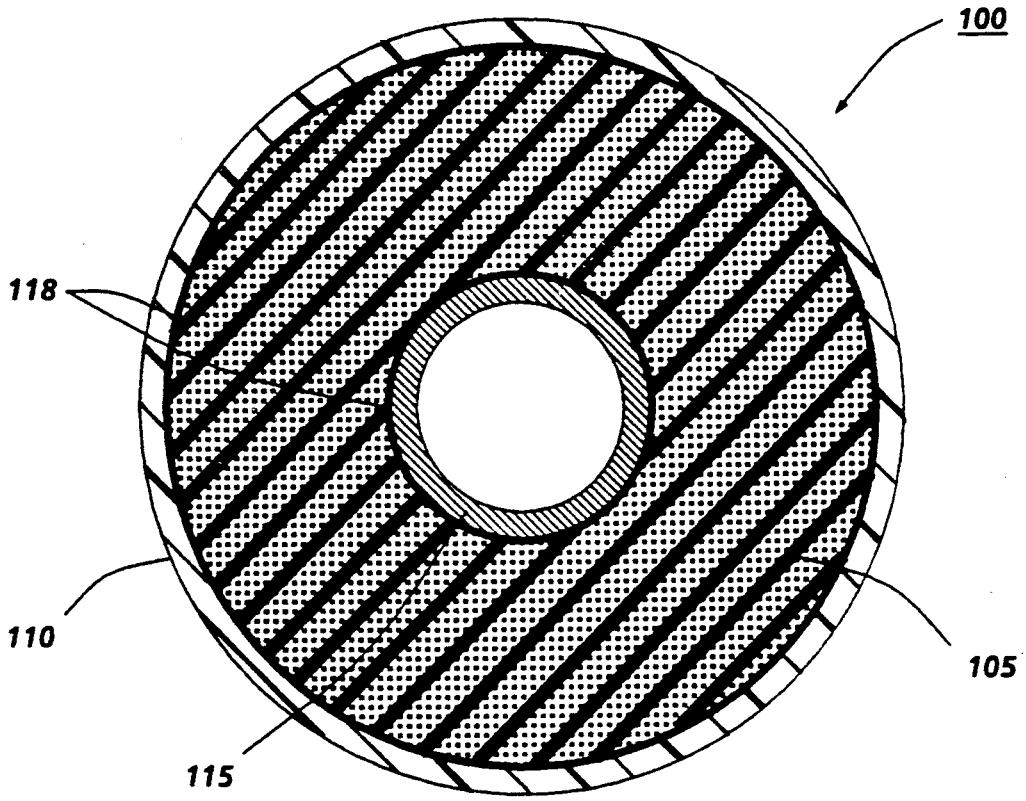
FIG. 2 is a side elevation of the idler roll structure of the present invention as shown in FIG. 1.
Figure 3:
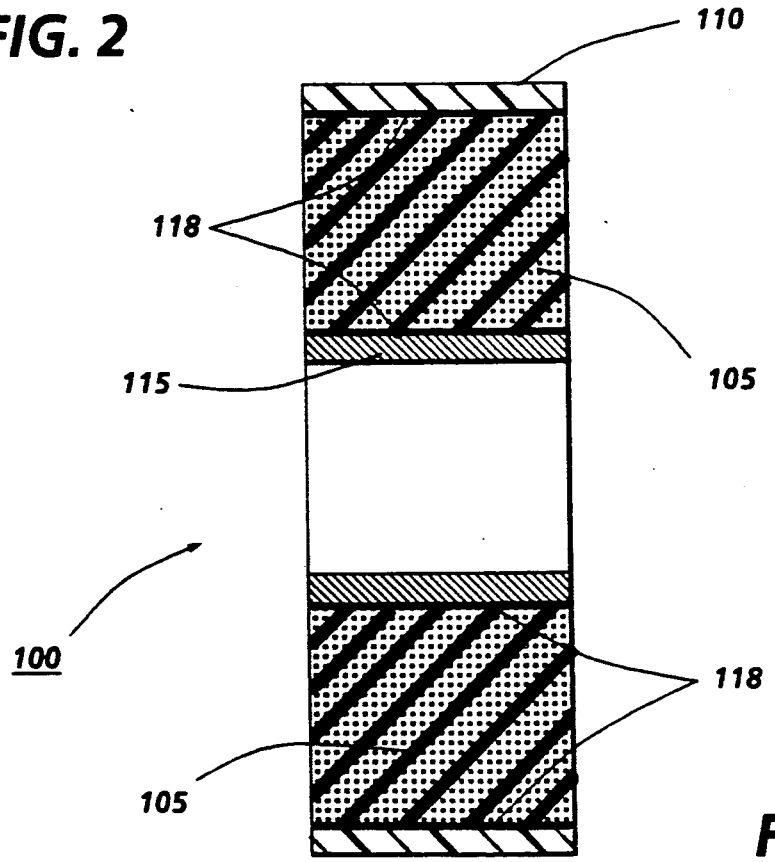
FIG. 3 is a front elevational view of the idler roll structure of FIG. 2.

Referring to FIG. 1 of the drawings, there is shown a xerograhic type reproduction machine 8 incorporating the present invention. Machine 8 has a suitable frame or housing (not shown) within which the machine xerographic section 13 is operatively supported. Briefly, and as will be familiar to those skilled in the art, the machine xerographic section 13 includes a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document 9 being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 32 brought forward in timed relation with the developed image on photoconductive surface 16, and cleaning station 34 that could include a cleaning blade and discharge corotron 36 for removing leftover developer from photoconductive surface 16 and neutralizing residual charges thereon.

Copy sheets 32 are brought forward to transfer station 28 by idler roll 100 and registration and drive roll 150, sheet guides 42, 43 serving to guide the sheet through an approximately 180° turn prior to transfer station 28. Following transfer, the sheet 28 is carried forward to a fusing section 48 where the toner image is fixed by fusing roll 49. Fusing roll 49 is heated by a suitable heater such as lamp 47 disposed within the interior of roll 49. After fixing, the copy sheet 28 is discharged.

A transparent platen 50 supports the document 9 as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 68 is disposed in predetermined operative relation to the photoconductive surface 16 in developer housing 65, roll 68 serving to bring developer from sump 66 into developing relation with photoreceptor 14 to develop the latent electrostatic images formed on the photoconductive surface 16. All of the machine functions are controlled by conventional controller or microprocessor C.

In the aforedescribed machine, and as particularly seen in FIG. 1, when sheets are guided into the nip formed between idler roll 100 and registration roll 150, a hard surfaced idler and drive roll would tend to transmit and sometimes magnify skew while conveying the sheets to another location within the machine. In order to diminish all possible skew in sheets that are fed into the machine 8, idler roll 100, in a preferred embodiment, is comprised of a one piece, low cost, self-loading, articulating structure that includes an outer core member 110 having an outer surface of sufficient hardness to be non-compliant when sheet material and a drive roll comes into contact with it. An inner core member or shaft 115 that is hollow or solid and has a compliant material 105, such as foam, is positioned between shaft 115 and outer core member 110 in order to allow the idler roll to articulate on the idler shaft to diminish skewed entry of sheets into the nip between the idler roll and the drive roll and thereby make it easier for an operator to place sheets into the machine. An adhesive 118 is placed between the inside surface of the outer core and the outside surface of the inner core in order to adhere the foam to both surfaces. The features incorporated into idler roll 100 that provide an advantage over prior idler rolls include: a smooth surface presented to a sheet allowing it to slide into a nip without any stall of the edges of the sheet; compliant action of the idler roll, the idler roll is loaded according to the stiffness of the foam, and is articulating; and the whole assembly is bonded together into a one piece composite for ease of assembly.

It should now be understood that a cost effective device for reducing skewed entry of sheets into the feed nip of a machine has been disclosed that is a one piece, low cost, self-loading, articulating and hard surfaced idler roll which includes a foam like material adhesively adhered between the outside surface of a hollow mounting shaft and the hard core of the idler. The foam like material allows the hard surface of the idler to articulate and thereby enhance deskewing of incoming sheets directed toward a nip formed between the idler roll and a drive roll.

While the invention has been described with reference to the structure shown, it is not confined to the specific details set forth, but is intended to cover such modifications or changes as may come within the scope of the following claims.

What is claimed is:

1. A copy sheet registration nip adapted to deskew incoming copy sheets, comprising: a drive roll; and a one piece, low cost, self-loading, articulating idler roll, said idler roll including an outer core member having an outer surface of sufficient hardness to be non-compliant when sheet material and said drive roll comes into contact with it, a shaft member and a compliant material positioned between said shaft member and outer core member, said compliant material being adapted to be deformed axially relative to said shaft member by said outer core member during articulation of said outer surface in order to allow said outer surface of said idler roll to articulate on said shaft member for sheet deskewing purposes.

2. The idler roll of claim 1, wherein said compliant material is a foam-like substance.

3. The idler roll of claim 2, wherein said foam-like substance includes inner and outer surfaces and an adhesive material positioned on said inner and outer surfaces.

* * * * *